US007674758B2

(12) United States Patent
Wahl et al.

(10) Patent No.: US 7,674,758 B2
(45) Date of Patent: Mar. 9, 2010

(54) FABRIC SOFTENING COMPOSITIONS COMPRISING FREE FATTY ACID

(75) Inventors: Errol Hoffman Wahl, Cincinnati, OH (US); Gerard Marcel Baillely, Cincinnati, OH (US); Ruth Anne Wagers, Middletown, OH (US); Gayle Marie Frankenbach, Cincinnati, OH (US); Jose Andres Rojo Moreno, Loveland, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 994 days.

(21) Appl. No.: 11/254,478

(22) Filed: Oct. 20, 2005

(65) Prior Publication Data

US 2006/0122087 A1 Jun. 8, 2006

Related U.S. Application Data

(60) Provisional application No. 60/621,204, filed on Oct. 22, 2004.

(51) Int. Cl.
*C11D 17/00* (2006.01)

(52) U.S. Cl. ..... 510/406

(58) Field of Classification Search ..... 510/406
See application file for complete search history.

(56) References Cited

U.S. PATENT DOCUMENTS

| | | | | |
|---|---|---|---|---|
| 6,110,886 | A | 8/2000 | Scepanski | |
| 6,291,421 | B1 | 9/2001 | Jacques et al. | |
| 6,608,014 | B1 * | 8/2003 | Schramm et al. | 510/296 |
| 2004/0142841 | A1 * | 7/2004 | de Buzzaccarini et al. | 510/296 |
| 2006/0019866 | A1 * | 1/2006 | Briggs et al. | 510/515 |

FOREIGN PATENT DOCUMENTS

EP 1431382 * 6/2004

* cited by examiner

*Primary Examiner*—John R Hardee
(74) *Attorney, Agent, or Firm*—David V. Upite; Mark A. Charles; Kim Williams Zerby

(57) ABSTRACT

Fabric conditioning compositions comprising at least 10% by weight free fatty acid are useful in softening fabrics.

18 Claims, No Drawings

FABRIC SOFTENING COMPOSITIONS COMPRISING FREE FATTY ACID

CROSS REFERENCE TO RELATED APPLICATION

This application claims priority to U.S. Provisional Application Ser. No. 60/621,204 filed Oct. 22, 2004, the disclosure of which is incorporated by reference herein.

FIELD OF INVENTION

The present invention relates to fabric softening compositions comprising a free fatty acid.

BACKGROUND OF THE INVENTION

Conventional fabric softening compositions are added in the rinse cycle of the laundering process to soften fabrics. However, adding such compositions during the rinse cycle can be inconvenient for the consumer, unless the consumer has a laundry washing machine that has a built-in fabric softener dispensing unit, a removable agitator post-mounted fabric softener dispenser, or has a fabric softener dosing device such as the DOWNY® Ball. Otherwise, the consumer has to monitor the laundering process and then manually add the fabric softener to the load as soon as the rinse cycle begins.

Softening-through-the-wash ("STW") compositions are able to soften fabrics while being added to the fabrics in the laundering process during the washing stage, negating the need to add a separate fabric conditioning composition to the rinse stage and/or drying stage of the laundering process. The STW compositions can thus be added to the load of laundry at the beginning of the laundering process, which provides the consumer with an efficient and easy way to soften fabric during the laundering process.

It is convenient to provide fabric softening compositions in the form of a unit dose. Previous attempts have been made to provide a unit dose fabric softening composition in the form of a tablet. However, such tablets tend to leave an undesirable visible residue on the treated fabrics and/or may provide only limited fabric softening benefits. See, e.g., U.S. Pat. No. 6,291,421 and U.S. Pat. No. 6,110,886. Tablets are thus generally not as well accepted by the consumer as softeners in liquid or gel forms.

There has thus been a need to provide a softening-through-the-wash composition that provides effective deposition of a fabric softening active on the treated fabrics to provide a consumer noticeable softening benefit, while avoiding the deposition of a visible residue on the treated fabrics.

SUMMARY OF THE INVENTION

One aspect of the invention provides a fabric softening composition comprising from about 10% to about 99% fatty acid by weight of the composition.

Another aspect of the invention provides a method of softening fabric comprising the step of administering, or causing to be administered, the composition of the present invention into the wash cycle of an automatic washing machine.

Yet another aspect of the invention provides an article comprising: (a) a unitized dose of a composition of the present invention; and (b) a water-soluble film, wherein the film encapsulates the composition.

Yet another aspect of the invention provides an article comprising: a unitized dose of a fabric care composition; and a water soluble film; wherein the composition comprises from about 10% to about 99% fatty acid by weight of the composition; wherein the article comprises less than about 5% by weight of the composition of a quaternary ammonium compound; wherein the unitized dose comprises a weight from about 1 g to about 60 g; and wherein the water soluble film encases the entire composition. Methods of using the articles of the inventions and kits comprising the articles are also provided.

DETAILED DESCRIPTION OF THE INVENTION

Fatty Acid

One aspect of the invention provides a fabric softening composition comprising a fatty acid, preferably a free fatty acid. The term "fatty acid" is used herein in the broadest sense to include unprotonated or protonated forms of a fatty acid; and includes fatty acid that is bound or unbound to another chemical moiety as well as the various combinations of these species of fatty acid. One skilled in the art will readily appreciate that the pH of an aqueous composition will dictate, in par, whether a fatty acid is protonated or unprotonated. In another embodiment, the fatty acid is in its unprotonated, or salt form, together with a counter ion, such as, but not limited to, calcium, magnesium, sodium, potassium and the like. The term "free fatty acid" means a fatty acid that is not bound (to another chemical moiety (covalently or otherwise) to another chemical moiety.

In one embodiment, the fatty acid may include those containing from about 12 to about 25, preferably from about 13 to about 22, more preferably from about 16 to about 20, total carbon atoms, with the fatty moiety containing from about 10 to about 22 , preferably from about 12 to about 18, more preferably from about 14 (midcut) to about 18, carbon atoms.

The fatty acid of the present invention is at a concentration from greater than about 10% to about 99% by weight of the composition. In one embodiment, the fatty acid of the present invention is between from about 20%, preferably about 40%, more preferably about 60%, more preferably about 70% to about 98%, preferably 97%, more preferably 95%, more preferably 90% by weight of the fabric softening composition of the present invention.

The present invention is based upon the surprising discovery that a fatty acid can be used as a principle fabric softening active if delivered to the laundry wash water (e.g., during the wash cycle or rinse cycle of an automatic laundry machine) in a sufficient quantity. Although fatty acids may have been added in laundry compositions in minor amounts, the present invention is based upon the surprising discovery that compositions comprising more than 10% by weight of the composition provide a noticeable fabric softening benefit. Higher concentrations are preferred, especially for unit dose packaging, so that the article is of a small size. This minimizes manufacturing costs and is preferred by the consumer. Lower concentrations are preferred for spray delivery packaging. While not to be bound by theory, it is believed that fatty acid can deposit in the wash cycle to lubricate fabric fibers and give a soft fabric feel benefit. It also believed that the fatty acid can complex with hardness ions, principally calcium and magnesium ions, in the wash cycle to form a soap complex which is then deposited onto the fabrics. It should also be recognized that free fatty acid itself can provide a softening benefit even if simply sprayed onto fabrics.

For purposes of the present invention, any number of analytical methods known in the art can be used to determine the concentration of fatty acid in a fabric softening composition of the present invention. Preferred methods are herein described below:

Total Fatty Acid Determination Test. The total fatty acids of the composition in question are extracted with petroleum ether from an acidified 50% alcohol solution of the product. This is done by three consecutive extractions using 30 mL petroleum ether (each) of a 50 ml solution of 1 gram of the composition in 1:1 ethanol:water acidified with 1:4 sulfuric acid solution. The combined organic extract is washed with the 50% alcohol solution until acid free. The organic extract is evaporated, and the fatty acids, of the composition in question, are dissolved in 20 mL of 1:1 ethanol:water and then are titrated with standard 0.1 N sodium hydroxide solution to phenolphthalein end point.

Free Fatty Acid Determination Test. The free fatty acids of the compositions are determined conducting the same extraction and titration procedures but starting with a non-acidified 50% alcohol solution of product. The amount of total and free fatty acids in the product is calculated using the average molecular weight of the fatty acid and their composition determined by gas liquid chromatography (GLC). The identity, composition, molecular weight and cis/trans ratio (for unsaturated isomers) of the fatty acid extracted from the composition in question are determined separately by capillary gas liquid chromatography of the methyl ester of the fatty acids. Methyl esters are prepared directly in the product using $BF_3$-Methanol reagent following a modification of the AOCS Official Method Ce2-66. Then the chain length composition of the fatty acid methyl esters is analyzed by matching GLC retention times of the fatty acid methyl esters against know standards following essentially the procedures described in AOCS Official Methods Ce 1c-89 and Ce 1f-96.

The fatty acids of the present invention may be derived from (1) an animal fat, and/or a partially hydrogenated animal fat, such as beef tallow, lard, etc.; (2) a vegetable oil, and/or a partially hydrogenated vegetable oil such as canola oil, safflower oil, peanut oil, sunflower oil, sesame seed oil, rapeseed oil, cottonseed oil, corn oil, soybean oil, tall oil, rice bran oil, palm oil, palm kernel oil, coconut oil, other tropical palm oils, linseed oil, tung oil, etc.; (3) processed and/or bodied oils, such as linseed oil or tung oil via thermal, pressure, alkali-isomerization and catalytic treatments; (4) a mixture thereof, to yield saturated (e.g. stearic acid), unsaturated (e.g oleic acid), polyunsaturated (linoleic acid), branched (e.g. isostearic acid) or cyclic (e.g. saturated or unsaturated α-disubstituted cyclopentyl or cyclohexyl derivatives of polyunsaturated acids) fatty acids. Non-limiting examples of fatty acids (FA) are listed in U.S. Pat. No. 5,759,990 at col 4, lines 45-66.

Mixtures of fatty acids from different fat sources can be used, and in some embodiments preferred. Nonlimiting examples of FA's that can be blended, to form FA's of this invention are as follows:

| Fatty Acyl Group | $FA^1$ | $FA^2$ | $FA^3$ |
|---|---|---|---|
| $C_{14}$ | 0 | 0 | 1 |
| $C_{16}$ | 3 | 11 | 25 |
| $C_{18}$ | 3 | 4 | 20 |
| C14:1 | 0 | 0 | 0 |
| C16:1 | 1 | 1 | 0 |
| C18:1 | 79 | 27 | 45 |
| C18:2 | 13 | 50 | 6 |
| C18:3 | 1 | 7 | 0 |
| Unknowns | 0 | 0 | 3 |
| Total | 100 | 100 | 100 |
| IV | 99 | 125-138 | 56 |
| cis/trans (C18:1) | 5-6 | Not Available | 7 |
| TPU | 14 | 57 | 6 |

$FA^1$ is a partially hydrogenated fatty acid prepared from canola oil, $FA^2$ is a fatty acid prepared from soybean oil, and $FA^3$ is a slightly hydrogenated tallow fatty acid.

It is preferred that at least a majority of the fatty acid that is present in the fabric softening composition of the present invention is unsaturated, e.g., from about 40% to 100%, preferably from about 55% to about 99%, more preferably from about 60% to about 98%, by weight of the total weight of the fatty acid present in the composition. As such, it is preferred that the total level of polyunsaturated fatty acids (TPU) of the total fatty acid of the inventive composition is preferably from about 0% to about 75% by weight of the total weight of the fatty acid present in the composition.

The cis/trans ratio for the unsaturated fatty acids may be important, with the cis/trans ratio (of the C18:1 material) being from at least about 1:1, preferably at least about 3:1, more preferably from about 4:1, and even more preferably from about 9:1 or higher.

The unsaturated fatty acids preferably have at least about 3%, e.g., from about 3% to about 30% by weight, of total weight of polyunsaturates.

Typically, one would not want polyunsaturated groups in actives since these groups tend to be much more unstable than even monounsaturated groups. The presence of these highly unsaturated materials makes it desirable, and for the preferred higher levels of polyunsaturation, highly desirable, that the fatty acids of the present invention herein contain antibacterial agents, antioxidants, chelants, and/or reducing materials to protect from degradation. While polyunsaturation involving two double bonds (e.g., linoleic acid) is favored, polyunsaturation of three double bonds (linolenic acid) is not. It is preferred that the C18:3 level in the fatty acid be less than about 3%, more preferably less than about 1%, and even more preferably less than about 0.1%, by weight of the total weight of the fatty acid present in the composition of the present invention. In one embodiment, the fatty acid present in the composition is essentially free, preferably free of a C18:3 level.

Branched fatty acids such as isostearic acid are preferred since they may be more stable with respect to oxidation and the resulting degradation of color and odor quality.

The Iodine Value or "IV" measures the degree of unsaturation in the fatty acid. In one embodiment of the invention, the fatty acid has an IV preferably from about 40 to about 140, more preferably from about 50 to about 120 and even more preferably from about 85 to about 105.

Free fatty acids or salts of fatty acids can be added to the washing or rinsing laundry bath at least at a concentration of about 150 parts per million ("ppm"), preferably at least about 230 ppm, and more preferably at least about 300 ppm, up to about 600 ppm. In one embodiment, the fatty acid does not exceed 1,000 ppm in the laundry or rinse bath. The concentration of fatty acid, and the preferred free fatty acid, in the laundry bath can be determined by any method accepted in the art. In one embodiment total fatty acid concentration is determined in the laundry bath. In another embodiment, the free fatty acid concentration is determined.

For purposes of the present invention, any number of analytical methods known in the art can be used to determine the concentration of a fatty acid of the present invention in a laundry bath or rinse bath (of e.g., an automatic washing machine). Preferred methods are herein described below:

Fatty Acid Determination Analysis. The concentration and type of total and free fatty acids delivered to the laundry or to rinsing bath are determined using a modification of the extraction procedure and the GLC method described above. The background contribution of fatty acids to the laundry/rinse bath from other sources (i.e. detergents, fabrics, stains, etc.) that are different from the fabric softening compositions need to be determined in separate blank samples and use to correct the results. A sample of the laundry bath (or of the rinse bath, preferably containing 50-100 milligrams of fatty acid) is diluted with the same volume of methanol spiked with a known amount (e.g., 10-20 mg) of pure nonadecanoic acid (C19:0). To determine the total fatty acids the spiked sample solution is acidified with a 1:4 sulfuric acid solution and then extracted with petroleum ether as described previously.

Free Fatty Acid Determination Analysis. To determine the concentration free fatty acids in the laundry bath (or in the rinse bath), a separate spiked sample solution is rapidly prepared and extracted directly (one single extraction) without acidification. If emulsions are formed, sodium chloride and some amyl alcohol can be used to cause phases to split during the extraction. After the organic extract are evaporated, the fatty acids methyl esters are prepared directly in the residue and analyzed by gas chromatography using the same modified AOCS methods described before. The ppm amounts and the composition of total and free fatty acids in the sample are calculated by internal standardization using as reference the amount of C19:0 internal standard added to extracts and the corresponding correction factors.

In one embodiment of the invention, the fabric softening composition of the present invention comprises less than 30%, preferably less than 10%, more preferably essentially free of any quaternary ammonium or amine fabric softening active.

In one embodiment, the fabric softening composition of the present invention is essentially free of a detersive surfactant. In another embodiment, the fabric softening composition further comprises a detersive surfactant.

Solvent

Solvents are useful for fluidizing the fabric softening compositions of the present invention, and may provide good dispersibility, and in some embodiments, provide a clear or translucent composition. Suitable solvents of the present invention can be water-soluble or water-insoluble. Non-limiting examples include ethanol, propanol, isopropanol, n-propanol, n-butanol, t-butanol, propylene glycol, 1,3-propanediol, ethylene glycol, diethylene glycol, dipropylene glycol, 1,2,3-propanetriol, propylene carbonate, phenylethyl alcohol, 2-methyl 1,3-propanediol, hexylene glycol, glycerol, sorbitol, polyethylene glycols, 1,2-hexanediol, 1,2-pentanediol, 1,2-butanediol, 1,4 butanediol, 1,4-cyclohexanedimethanol, pinacol, 1,5-hexanediol, 1,6-hexanediol, 2,4-dimethyl-2,4-pentanediol, 2,2,4-trimethyl-1,3-pentanediol (and ethoxylates), 2-ethyl-1,3-hexanediol, phenoxyethanol (and ethoxylates), glycol ethers such as butyl carbitol and dipropylene glycol n-butyl ether, ester solvents such as dimethyl esters of adipic, glutaric, and succinic acids, hydrocarbons such as decane and dodecane, or mixtures thereof.

Other examples of solvents include so called "principal solvents" preferably having a ClogP of from about −2.0 to about 2.6, more preferably from about −1.7 to about 1.6, as defined hereinafter, typically at a level that is less than about 50%, preferably from about 1% to about 25%, more preferably from about 3% to about 25% by weight of the composition. The "calculated logP" (ClogP) is determined by the fragment approach of Hansch and Leo (cf., A. Leo, in Comprehensive Medicinal Chemistry, Vol. 4, C. Hansch, P. G. Sammens, J. B. Taylor and C. A. Ramsden, Eds., p. 295, Pergamon Press, 1990. Principle solvents or principal solvent systems are described at page 19, line 12 et seq. of WO 99/27050 (pending as U.S. application Ser. No. 98/25079, filed Nov. 24, 1998 (P&G Case 7258X)).

It will be recognized that solvents can be in solid form at room temperature and are not required to be liquids; for example, 1,4-cyclohexanedimethanol is a solid at 25° C. In addition, surface active materials can be solvents, preferably nonionic or anionic surfactants. Especially preferred are alcohol ethoxylates.

The level of aqueous or aqueous plus solvent carrier may generally constitute the balance of the present compositions.

Water

The level of water in the fabric softener compositions of the present invention is generally very low, less than about 20%, preferably less than about 10%, more preferably less than about 5%, and most preferably less than about 1%, or alternatively about 0% by weight of the composition. If the composition is dosed as a soluble unit dose, high water levels can cause the films used (for example, polyvinyl alcohol) to encapsulate said compositions of the present invention to leak or start to dissolve or disintegrate prematurely, either in the manufacturing process, during shipping/handling, or upon storage. However, it has been found that a low level of water can be desirable as medium for adding water-soluble colorants and hueing dyes to the composition to give it an attractive color and to distinguish between compositions with different perfumes and/or added fabric care benefits. Oil soluble dyes and pigments can be used without the use of water medium but are not preferred since they can cause fabric staining to occur.

Plasticizers

For compositions intended to be enclosed or encapsulated by a film, such as in a unit dose, especially a highly water-soluble film like polyvinyl alcohol, it is desirable to incorporate the same or similar plasticizers found in the film into the fabric softener composition. This helps reduce or prevent migration of the film plasticizers into the softener composition. Loss of plasticizers from the film can cause the article to become brittle and/or lose mechanical strength over time. Typical plasticizers to include in the highly concentrated fabric softener composition are glycerin, sorbitol, 1,2 propanediol, polyethylene glycols, other diols and glycols, and mixtures thereof. Compositions may contain from at least about 0.1%, preferably at least about 1%, and more preferably at least about 5% to about 50% plasticizer or mixtures of plasticizers, by weight of the composition.

Hueing Dyes

One aspect of the invention provides a fabric softening composition comprising a hueing dye Typically water soluble blue and violet dyes are used as hueing agents in the present invention at levels in a fabric softening, rinse added, composition from about 0.00001 wt. % to about 1 wt. %, preferably from about 0.0003 wt. % to about 0.05 wt. %.

One embodiment of the invention provides administering the hueing dyes in the present invention in an amount in the washing machine such that a concentration of from about 0.5 parts per billion (ppb) to about 5 part per million, preferably about 1 ppb to about 600 ppb, more preferably about 5 ppb to about 300 ppb, even more preferably about 10 ppb to about 100 ppb of hueing dye is achieved during the washing cycle, or rinse cycle, of an automatic laundry washing machine.

Suitable hueing dyes are described in U.S. Provisional Application No. 60/617,613 filed Oct. 8, 2004, to L. G. Brush et al, entitled "Fabric Care Compositions Comprising Hueing Dye," (P&G Case No. 9795P). For wash added applications, the hueing dye may be selected according to co-pending applications U.S. Provisional Application Nos. 60/583,745; and 60/583,750, both filed Jun. 29, 2004, and both to E. S. Sadlowski, et al. (P&G Case No. 9694P and 9695P, respectively).

Brighteners

One aspect of the invention provides for a fabric care composition comprising a brightener. "Brightener" (also called "optical brightener") is used herein the broadest sense to include any compound that exhibits fluorescence. This includes all compounds that absorb UV light and reemit as "blue" visible light. Suitable optical brighteners include fluorescent whitening agents (FWAs) and are more fully described in the following: (1) Ullman's Encyclopedia of Industrial Chemistry, Fifth Edition, Vol. A18, Pages 153 to 176; (2) Kirk-Othmer Encyclopedia of Chemical Technology, Volume 11, Fourth Edition; and (3) Fluorescent Whitening Agents, Guest Editors R. Anliker and G. Muller, Georg Thieme Publishers Stuttgart (1975). Preferred FWAs are described in U.S. Provisional Application No. 60/617,613 filed Oct. 8, 2004, to L. G. Brush et al, entitled "Fabric Care Compositions Comprising Hueing Dye," (P&G Case No. 9795P).

One embodiment of the invention provides administering an FWA in the present invention in an amount in the washing machine such that a concentration is from about 0.05 parts per million (ppm) to about 25 ppm, preferably about 0.1 ppm to about 20 ppm, more preferably about 0.5 ppm to about 15 ppm, even more preferably about 1 ppm to about 10 ppm of FWA is achieved during the washing cycle, or preferably rinse cycle, of an automatic laundry washing machine. CBS-X optical brightener is preferred due to its good water solubility of about 2.5 weight percent at 25° C.

Dispersing Agents

Dispersing agents of the present invention can be anionic, cationic, nonionic, amphoteric, or zwitterionic surface active agents or mixtures thereof. If a cationic surfactant is used, it will be generally used at lower levels from about less than 10%, preferably less that about 5%, and more preferably less than about 1% by weight of the fabric softening composition. These lower levels of cationic surfactants can be effectively used in combination with nonionic surfactants. Nonionic surfactants are very useful as dispersing agents and are preferred. The nonionic surfactant is preferably an alkoxylated nonionic surfactant, especially an ethoxylated nonionic surfactant. Suitable nonionic surfactants further include nonionic surfactants derived from saturated and/or unsaturated primary, secondary, and/or branched, amine, amide, amine-oxide fatty alcohol, fatty acid, alkyl phenol, and/or alkyl aryl carboxylic acid compounds, each preferably having from about 6 to about 22, more preferably from about 8 to about 18, carbon atoms in a hydrophobic chain, more preferably an alkyl or alkylene chain, wherein at least one active hydrogen of said compounds is ethoxylated with 50, preferably 30, more preferably from about 5 to about 15, and even more preferably from about 8 to about 12, ethylene oxide moieties to provide an HLB of from about 8 to about 20, preferably from about 10 to about 18, and more preferably from about 11 to about 15. Suitable nonionic surfactants are described in more detail in U.S. Pat. No. 6,514,931 at col. 8, lines 1-24; U.S. Pat. No. 6,492,322; and U.S. application Ser. No. 09/554,969, filed Nov. 24, 1998 by Frankenbach et al. (WO 99/27050).

When present, nonionic surfactants are typically present in the compositions at a level of from about 0.01% to about 25%, preferably from about 0.05% to about 10%, and more preferably from about 0.1% to about 5%, by weight of the composition. Suitable nonionic surfactants include those commercially-available from Shell Chemicals under the trade name NEODOL® 91-8 and from BASF under the trade name PLURONIC® L35.

Detergent Actives

One embodiment of the invention provides for a composition that comprises less than 5%, alternatively less than 4%, alternatively less than 3%, alternatively less than 2%, alternatively less than 1% by weight of the composition; alternatively substantially free, alternatively free, of a detergent active. The term "detergent active" refers to detergent surfactants, detergent builders, chlorine bleaching agents and mixtures thereof. In turn, "detergent surfactants" should be understood to refer to surfactants, primarily anionic surfactants, that are most well known for their detersive action in removing soil and stains form fabrics.

Quaternary Ammonium Compounds

One embodiment of the invention provides for a composition that comprises less than 5%, alternatively less than 4%, alternatively less than 3%, alternatively less than 2%, alternatively less than 1% by weight of the composition; alternatively substantially free, alternatively free, of a quaternary ammonium compound. Examples of quaternary ammonium compounds includes those described in U.S. Pat. Pub. No. 2004/0204337 A1, from paragraphs 30-79; or U.S. Pat. No. 6,494,920, at column 1, line 51 et seq. detailing an "esterquat" or a quaternized fatty acid triethanolamine ester salt.

Kit

One aspect of the invention provides for a kit comprising a composition of the present invention and optionally instructions for use. In one embodiment, the instructions instruct the user to add the composition to an automatic washing machine.

Optional Fabric Care Actives

Silicones

In one embodiment of the invention, the fabric care composition comprises a silicone as an optional fabric care active. Silicones can be used to impart a lubricating property, or increased gliding ability, to fibers in fabric, particularly clothing. Non-limiting examples of useful silicones in the composition of the present invention include noncurable silicones such as polydimethylsilicone, non-curable aminofunctional silicones, volatile silicones, and curable silicones such as aminosilicones, phenylsilicones, hydroxysilicones, and silicone polyethers. The word "silicone" as used herein preferably refers to emulsified silicones, including those that are commercially available and those that are emulsified in the composition, unless otherwise described. Preferably, the silicones are hydrophobic; are neither irritating, toxic, nor otherwise harmful when applied to fabric or when they come in contact with human skin; are chemically stable under normal use and storage conditions; and are capable of being deposited on fabric.

When silicone is present, it is present at least an effective amount to provide lubrication of the fibers, typically from about 0.1% to about 30%, preferably from about 0.2% to about 20%, more preferably from about 0.3% to about 10%, by weight of the composition.

In one embodiment, the silicone can be either a polydimethyl siloxane (polydimethyl silicone or PDMS), or a derivative thereof, e.g., amino silicones, ethoxylated silicones, etc. The PDMS, is one having a viscosity of from about 2 to about 1,000,000 cSt, preferably from about 5 to about 1,000,000 cSt, more preferably from about 100 to about 500,000 cSt., and even more preferably from about 5000 to 330,000 cSt.

Clays

In one embodiment of the invention, the fabric care composition may comprise a clay as an optional fabric care active. Preferred clays include those materials classified geologically smectites and are described in U.S. Pat. Appl. Publ. 20030216274 A1, to Valerio Del Duca, et al., published Nov. 20, 2003, paragraphs 107-120.

Other suitable clays are described U.S. Pat. Nos. 3,862,058; 3,948,790; 3,954,632; and 4,062,647.

Softening Oils

Another class of optional fabric care actives is softening oils, which include but are not limited to, vegetable oils (such as soybean, sunflower, and canola), hydrocarbon based oils (natural and synthetic petroleum lubricants, preferably polyolefins, isoparaffins, and cyclic paraffins), triolein, fatty esters, fatty alcohols, fatty amines, fatty amides, and fatty ester amines. Oils can be combined with fatty acid softening agents, clays, and silicones. Oils may be less effective than fatty acids and may require a higher usage level for softness performance.

Adjunct Ingredients

The present compositions optionally, but preferably, comprise additional adjunct ingredients, preferably selected from the group consisting of perfume, nonionic surfactant, non-aqueous solvent, dye, preservatives, optical brighteners, anti-foam agents, and mixtures thereof. Although not intending to be limiting, the amount of each optional adjunct ingredient, if present, is typically up to about 10.0%, by weight of the composition, unless otherwise specified.

In one embodiment, the fabric conditioning composition comprises a perfume. Perfume is typical incorporated in the present compositions at a level of at least about 0.001%, preferably at least about 0.01%, more preferably at least about 0.1%, and no greater than about 10%, preferably no greater than about 5%, more preferably no greater than about 3%, by weight of the composition.

In one embodiment, the perfume of the fabric conditioning composition of the present invention comprises an enduring perfume ingredient(s) that have a boiling point of about 250° C. or higher and a ClogP of about 3.0 or higher, more preferably at a level of at least about 25%, by weight of the perfume. Suitable perfumes, perfume ingredients, and perfume carriers are described in U.S. Pat. No. 5,500,138; and US 2002-0035053 A1.

In another embodiment, the perfume comprises a perfume microcapsule and/or a perfume nanocapsule all herein referred to collectively as a "perfume microcapsule." Suitable perfume microcapsules may include those described in the following references: US 2003-215417 A1; US 2003-216488 A1; US 2003-158344 A1; US 2003-165692 A1; US 2004-071742 A1; US 2004-071746 A1; US 2004-072719 A1; US 2004-072720 A1; EP 1393706 A1; US 2003-203829 A1; US 2003-195133 A1; US 2004-087477 A1; US 2004-0106536 A1; U.S. Pat. Nos. 6,645,479; 6,200,949; 4,882,220; 4,917,920; 4,514,461; U.S. RE 32713; U.S. Pat. No. 4,234,627.

In yet another embodiment, the fabric conditioning composition of the present invention comprises odor control agents. Such agents include those described in U.S. Pat. No. 5,942,217: "Uncomplexed cyclodextrin compositions for odor control", granted Aug. 24, 1999. Other agents suitable odor control agents include those described in the following: U.S. Pat. Nos. 5,968,404, 5,955,093; 6,106,738; 5,942,217; and 6,033,679.

The present compositions can further comprise additional optional components such as oily sugar derivatives, such as those disclosed in WO 01/46361 and U.S. Pat. No. 6,514,931. The present compositions can also further comprise optional anionic surfactants. However, if anionic surfactants are present, they are preferably included at a level of less than about 10%, preferably from about 0.1% to about 5%, more preferably from about 0.1% or less to about 1% by weight of the composition. The present compositions can also be free of anionic surfactants.

Composition Forms

The present compositions can be liquid, gel, or solid form, but are preferably a liquid form. Liquid compositions of the present invention can be clear, translucent, or opaque (dispersions). Solid compositions of the present invention can be incorporated onto a substrate material, preferably a non-woven substrate material, for use in treating fabrics in a laundry dryer. Suitable substrate materials are described in U.S. Pat. Nos. 5,929,026; 5,883,069; and 5,470,492. The present compositions can also be provided in a unit dose form, for example, as a liquid composition contained in a water-soluble film (e.g. polyvinyl alcohol film) or as a solid tablet unit dose form. Spray-on compositions may also be suitable. If the compositions of the present invention are to be used in an article comprising a container with a spraying device (such as a trigger sprayer or an aerosol), the fatty acid concentration in the composition is typically less than about 50%, preferably less than about 25%, more preferably less than about 10%, and most preferably between about 1% to about 8% by weight of the composition. These more dilute compositions may be obtained by simple dilution of the more concentrated compositions of the present invention with water, or by making dilute compositions of fatty acid in water and/or solvents by classical emulsion making procedures well-known to those skilled in the art.

The present compositions may generally have a pH of from about 2 to about 12, preferably from about 3 to about 10, and more preferably from about 4 to about 9

In one embodiment, the fabric care composition is a wash added composition (i.e., added during the wash cycle of an automatic laundry machine). In another embodiment, the fabric care composition is a rinse added composition (i.e., added during the rinse cycle of an automatic laundry machine). In another embodiment, the fabric care composition is administered as a unit dose. In another embodiment, the fabric care composition is concentrated. In another embodiment, the fabric care composition is dilute.

In one embodiment, the fabric care composition of the present invention is essentially free of detersive detergent. In another embodiment, the fabric care composition comprises between about 0.0001% to about 10% of detersive detergent by weight of the composition.

In another embodiment, the fabric care composition and article of the present invention is used in combination with a detersive detergent composition, wherein said detersive detergent composition also includes a fatty acid. This provides for a laundry system of fatty acid softening benefits wherein the softness effects to fabric are enhanced.

Unit Dose

The present invention can provide an article containing a unitized dose of a concentrated embodiment of a composition of the present invention that may be used to provide an excellent softening effect and convenience, the article comprising an effective amount of a highly concentrated fabric conditioning composition as referenced above, and a coating, film, encapsulate or carrier for the concentrated fabric softening composition that is at least partially water-soluble. The coating/carrier is preferably selected from the group consisting of hard gelatin, soft gelatin, polyvinyl alcohol, hydroxypropyl methylcellulose, polyvinyl pyrrolidone, zeolites, waxy polymers, sugar, sugar derivatives, starch, starch derivatives, effervescing materials, and mixtures thereof. The volume of the concentrated fabric conditioning composition contained within the article can vary between about 0.5 ml and about 100 ml, preferably from about 2 ml to about 50 ml, alternatively between about 0.5 ml to about 2 ml, alternatively between about 2 ml to about 10 ml, alternatively between about 1 ml to about 5 ml when the fabric softening composition is in a liquid or other flowable form such as a gel. The article can also be in the form of a tablet or effervescing tablet or ball.

The materials and methods that may be used to manufacture the articles of the present invention are more fully described in US Patent Publication US 2003-0104969A1 by Caswell et al. Another example of a suitable water-soluble pouch by which the composition of the present composition may be administered includes one described in US 2004/0142841 A1 between paragraphs 20 to 37. Pouches can be made and filled in any conventional manner as disclosed in, for example, US 2003-0216274A1; U.S. Pat. Nos. 6,727,215; 6,750,187; 6,740,628; 6,683,036; 6,567,303; 6,557,732; and 6,344,994.

The articles of the present invention utilize a wide range of materials and processes to deliver a pre-measured or unitized amount of highly concentrated fabric softening composition to a laundry solution by dispensing in that solution an article containing an effective amount of a concentrated fabric softening composition as described above. The dose forms and articles of the present invention should be sufficiently water-soluble so that the materials of the articles will rapidly dissociate upon contact with water, thereby releasing the softening composition to the solution within the first several seconds and/or minutes of contact with the solution.

Specifically, in its most simplified form, an article of the present invention comprises a unitized amount a fabric softener active that is at least about 40%, more preferably at least 50%, and even more preferably at least about 65%, and most preferably at least about 75% by weight of the composition, and wherein the composition has less than about 20%, more preferably less than about 10% and even more preferably less than about 5%, and most preferably less than about 1%, water by weight of the composition, and having a coating, film, encapsulate or carrier material that is at least partially water-soluble.

As used herein, "unitized" refers to the amount of fabric softening composition that should be delivered to a laundry solution to provide an effective amount of the fatty acid of the present invention to a minimum volume of fabrics in a minimum volume of laundry solution, to thereby produce the desired conditioning (e.g., softening) effect. For loads containing larger volumes of fabrics, multiple units or doses of the fabric-softening article may be needed to provide the desired softening effect.

The unitized dose article of the present invention will have an overall weight between about 0.05 g and about 100 g, more preferably between about 2 g and about 50 g, and even more preferably between about 4 g and about 35 g. The articles may have at least one dimension (e.g. length, width, height, diameter etc.) that is less than about 15 mm when the articles are to be dispensed in the rinse bath with a dispenser. Although optional, it is preferred that the articles of the present invention have identification means to aid in the identification of articles that contain different actives, perfumes and that provide various benefits. Preferred identification means may include article features of color, odor, texture, opacity, pearlescence, size, shape, embossing, debossing, applied or printed markings and mixtures thereof.

Once dispensed in the laundry solution, the materials of the article should rapidly dissociate, dissolve and/or disintegrate in order to rapidly release the active or mixture of actives. The dissolution rate of the articles of the present invention should be rapid across a broad range of pH conditions so that the dissolution occurs rapidly in both the high pH solutions typically found in the wash and the relatively lower pH solutions (more neutral pH) typically found in the rinse. Further, the articles should rapidly dissociate across a broad range of temperature conditions. Specifically, it is preferred that the articles have a dissolution rate between about 0.05 min and about 5 min, and more preferably between about 0.05 min and 1 min in an aqueous bath at about 24° C. Similarly, in an aqueous bath at about 10° C., it is preferred that the articles dissolve in less than about 15 min., preferably less than about 10 min, more preferably less than about 5 min, even more preferably less than about 3 min and even still more preferably less than about 2 min. At about 4° C., it is preferred that the articles dissolve in less than about 15 min., preferably less than about 10 min, more preferably less than about 5 min, even more preferably less than about 3 min and even still more preferably less than about 2 min.

The concentrated fabric conditioning compositions may be dispensed to the laundry solution in a variety of forms including but not limited to solids, waxy solids, pastes, liquids, slurries, dispersions, gels, foams, sprays and aerosols. Further, these materials may be encapsulated, molded, compacted, coated or applied to a substrate to form a unitized article or dose form. A number of non-actives may optionally be included to facilitate the manufacture, processing, dispensing and dissociation of the composition through a variety of dose forms.

Solid forms of the articles will include or be comprised of powders, pellets, granules, tablets including but not limited to dimple tablets, bars, spheres, sticks, and virtually any other form that may be created through the use of compression or molding. Further, it is preferred that solid articles be sufficiently robust to withstand handling, packaging, and distribution without breakage, leakage or dusting prior to being dispensed in a laundry solution. It is preferred that the articles of the present invention will be in the form of a capsule, tablet, sphere or an encapsulate such as a pouch, pillow, sachet, bead, or envelope. Where the article is in the form of a tablet, it is preferred that the composition further comprise an effervescent composition to increase the dissolution rate of the tablet when it is dispensed into the rinse bath solution.

The coating, film, encapsulate or carrier materials that are preferred for the manufacture of the articles of the present invention include hard gelatins, soft gelatins, polyvinyl alcohols, polyethylene oxide, polyvinyl pyrrolidone (PVP), hydroxypropyl methylcellulose, zeolites, waxy polymers such as polyethylene glycols, sugars, sugar derivatives, starches, starch derivatives, effervescing materials, and mixtures thereof.

When an encapsulated article is desired, these materials may be obtained in a film or sheet form that may be cut to a desired shape or size. Specifically, it is preferred that films of polyvinyl alcohol, polyethylene oxide, hydroxypropyl methyl cellulose, methyl cellulose, non-woven polyvinyl alcohols, PVP and gelatins or mixtures be used to encapsulate the concentrated fabric softening compositions. Polyvinyl alcohol films are commercially available from a number of sources including Chris Craft Industrial Products Inc., of Gary, Ind., Nippon Synthetic Chemical Industry Co. Ltd. Of Osaka Japan, and Ranier Specialty Chemicals of Yakima, Wash. These films may be used in varying thicknesses ranging from about 20 to about 80 microns preferably between about 25 to at least about 76 microns. For purposes of the present invention, it is preferred to use a film having a thickness of about 25 to about 40 micrometers for rapid dissolution in cold water. Where larger volumes of composition are to be contained in encapsulate, volumes exceeding about 25 ml, a thicker film may be desired to provide additional strength and integrity to the encapsulate. Further, it is preferred that the water-soluble films be printable and colored as desired.

In one embodiment, the polyvinyl alcohol film is made of polyvinyl alcohol being partially hydrolyzed from about 65 mol % to about 85 mol %, preferably from about 70 mol % to about 75 mol %. Also, it is preferred that the polyvinyl alcohol has a solution viscosity at 4% concentration in water at 20° C. of from about 1 to about 8 mPa-s, preferably from about 3 to about 7 mPa-s. One useful fast dissolving polyvinyl alcohol (PVA) film for making articles of the present invention is KP-06 from Nippon Gohsei. The PVA is from about 71 to about 74 mol % hydrolyzed and has a viscosity of from about 5 to about 7 mPa·s (cPs). The viscosity is measured with a 4% PVA solution in water at 20° C. The preferred range of thickness for the KP-06 film is from about 20 microns to about 60 microns.

Sprays

One aspect of the invention provides an article comprising the composition of the present invention and a spray dispenser Such articles are described in U.S. Pat. Nos. 6,491,840; 6,652,766; 6,645,392; and 6,459,058. Preferred articles of the present invention are those that comprise the composition of the present together with a spray dispenser having uniform spray characteristics. Surprisingly, articles with uniform spray characteristics spraying the compositions of the present invention provide better dry times and reduced staining despite the presence of solids in the composition. Also, the uniform deposition of the composition gives the most uniform benefits including, but not limited to softness and wrinkle control.

Dispensers that are useful in the present invention produce a spray that provides uniform distribution on a surface which can be described by the parameters of volume dispensed per unit of surface area and the standard deviation in the volume dispensed per unit of surface area as follows: volume per unit surface area of less than about 0.07 ml/inch$^2$ (0.011 ml/cm$^2$); preferably less than about 0.05 ml/inch$^2$(0.0078 ml/cm$^2$); more preferably less than about 0.035 ml/inch$^2$ (0.0054 ml/cm$^2$); even more preferably less than about 0.025 ml/inch$^2$ (0.0039 ml/cm$^2$); and most preferably less than about 0.02 ml/inch$^2$ (0.0031 ml/cm$^2$); with a standard deviation in the volume per unit surface area of less than about 0.056 ml/inch$^2$ (0.0087 ml/cm$^2$); preferably less than about 0.05 ml/inch$^2$ (0.0078 ml/cm$^2$); more preferably less than about 0.03 ml/inch$^2$ (0.0047 ml/cm$^2$); even more preferably less than about 0.022 ml/inch (0.0034 ml/cm$^2$); still more preferably less than about 0.02 ml/inch$^2$ (0.0031 ml/cm$^2$); most preferably less than about 0.018 ml/inch$^2$ (0.0028 ml/cm$^2$).

In one aspect of the present invention, preferred compositions have acceptable levels of extensional viscosity. Not to be bound by theory, it is believed that to distribute the product well from a dispenser, the product must be able to form distinct small droplets and an adequate-size spray pattern. Both spray characteristics, i.e., droplet size distribution and spray pattern, depend strongly on the extensional viscosity of the product, and to a lesser extent on shear viscosity, density and surface tension. The effect of product density on the spray characteristics is minimal since for most products the density varies only slightly (e.g. between 0.8 and 1.2 g/cm$^3$). On the other hand, the surface tension of the product affects the droplet size distribution (i.e., higher surface tension causes formation of larger droplets), but not the size of the spray pattern for pressure swirl atomizers. Finally, as the shear viscosity increases the size of the droplets increases, and in pressure swirl atomizers the spray pattern decreases. The extensional viscosity of the product is typically denoted as the Trouton ratio, which is the ratio of the extensional viscosity to the shear viscosity. The Trouton ratio of Newtonian fluids is constant and equal to 3 (e.g. water and glycerin; regardless of the extensional and shear rates), whereas that of solutions of flexible polymers is much greater than 3 (e.g. polyacrylamide; dependent on the extensional and shear rates). The Trouton ratio of solutions of rigid polymers (e.g. xanthan; dependent on the extensional and shear rates) is typically less than that of the solutions of flexible polymers. Acceptable compositions should have a Trouton ratio of less than about 10,000 at extensional rates of less than 20,000 s$^{-1}$.

Preferred articles of the present invention have a fast dry time as measured by the dry time method below. The dry time of the article can be characterized at several different dry times. Typically for an article producing a fast dry time, more than about 95% of the weight of the composition on the surface is gone in 2 minutes, preferably about 85% of the weight of the composition on the surface is gone in 2 minutes and most preferably about 80% of the weight of the composition on the surface is gone in 2 minutes. Typically for an article producing a fast dry time, more than about 85% of the weight of the composition on the surface is gone in 5 minutes, preferably more than about 70% of the weight of the composition on the surface is gone in 5 minutes and most preferably more than about 60% of the weight of the composition on the surface is gone in 5 minutes. Typically for an article producing a fast dry time, more than about 60% of the weight of the composition on the surface is gone in 10 minutes, preferably more than about 40% of the weight of the composition on the surface is gone in 10 minutes and most preferably more than about 20% of the weight of the composition on the surface is gone in 10 minutes.

Methods for Measuring Spray Characteristics of the Article

A. Patternator Test

The Patternator Test method is used to evaluate a spray pattern of a spray dispenser. The Patternator Test generates data to quantify a spray pattern in terms of volume of liquid per unit of surface area covered by the spray. A standard deviation is also calculated from this test method.

An apparatus used to perform the Patternator Test method is shown in FIG. 1 of U.S. Pat. No. 6,491,840, granted Dec. 10, 2002, to Frankenbach et al. and described at column 92, line 53 to column 93, line 35.

B. Staining Test The Staining Test is described in U.S. Pat. No. 6,491,840 from column 93, lines 35-48 and carried out by spraying a composition of the present invention onto a hanging fabric from a selected spray dispenser with a distance of 6 inches between the nozzle of the spray dispenser and the surface of the fabric. Briefly, the number of swatches with a visible stain is tabulated and the number of stains per ten swatches sprayed is reported.

C. Dry Time Test

The Dry Time Test is described in U.S. Pat. No. 6,491,840 from column 93, line 49 to column 94, line 6 linesD. Spray Pattern Test The Spray Pattern Test is described in U.S. Pat. No. 6,491,840 at column 94, lines 7 to 27.

EXAMPLES

| INGREDIENTS | I | II | III | IV |
|---|---|---|---|---|
| Oleic Acid [a] | 75.00% | 75.00% | 75.00% | 75.00% |
| 1,2 Propanediol | 17.50% | 15.00% | 20.00% | 17.50% |
| Neodol 91-8 [b] | 5.00% | 5.00% | 5.00% | 5.00% |
| Perfume | 2.50% | 5.00% | — | 2.50% |
| Blue Dye [c] | 30 ppm | 30 ppm | — | — |

[a] Derived from canola oil.
[b] $C_{9-11}$ alcohol ethoxylate with an average of 8 moles of ethylene oxide (available from Shell).
[c] Liquitint Blue DW (available from Milliken Chemical).

The process consists of mixing the oleic acid and 1,2 propanediol; then adding the Neodol 91-8, followed by the perfume and dye. Example III is mixed and produced a clear liquid composition.

The composition of Example I is encapsulated in a polyvinyl alcohol film using a vacuum forming and heat sealing process to form a unit dose pouch. The polyvinyl alcohol film was Monosol 8630 and was 76 microns thick. The net weight of the composition encapsulated as an article was 20 g. Another unit dose pouch is made with KP-06 polyvinyl alcohol film from Nippon Gohsei. The PVA is from about 71 to about 74 mol % hydrolyzed and has a viscosity of from about 5 to about 7 mPa·s (cPs). The viscosity is measured with a 4% PVA solution in water at 20° C. The thickness of the KP-06 film was about 40 microns. The net weight of the composition encapsulated as an article is 20 g.

The composition of Example III is evaluated for softness performance and is found to give a noticeable softness benefit on 100% cotton terry clothes.

The composition of Example IV is diluted with water to an oleic acid concentration of 5%. The diluted composition is placed into a plastic bottle with a trigger sprayer to form an article. The composition is sprayed onto dry fabrics to provide a softness feel benefit.

The composition of Example IV is diluted with water to an oleic acid concentration of 5%. The diluted composition is placed into an aluminum aerosol can with an aerosol spray value and actuator, and then charged with nitrogen to form a pressurized article. The composition is sprayed onto dry fabrics to provide a softness feel benefit.

It should be understood that every maximum numerical limitation given throughout this specification includes every lower numerical limitation, as if such lower numerical limitations were expressly written herein. Every minimum numerical limitation given throughout this specification includes every higher numerical limitation, as if such higher numerical limitations were expressly written herein. Every numerical range given throughout this specification includes every narrower numerical range that falls within such broader numerical range, as if such narrower numerical ranges were all expressly written herein.

All parts, ratios, and percentages herein, in the Specification, Examples, and claims, are by weight and all numerical limits are used with the normal degree of accuracy afforded by the art, unless otherwise specified.

All documents cited in the Detailed Description of the Invention are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An article comprising: a unitized dose of a fabric care composition; and a water soluble film;

wherein the composition comprises from about 10% to about 99% fatty acid by weight of the composition;

wherein the article comprises less than about 5% by weight of the composition of a quaternary ammonium compound;

wherein the unitized dose comprises a weight from about 1 g to about 60 g;

wherein the water soluble film encases the entire composition; and wherein the article comprises less than 5% by weight of the composition of an anionic surfactant wherein the composition further comprises a hydrophilic plasticizer.

2. The article of claim 1, wherein the fatty acid comprises a free fatty acid.

3. The article of claim 2, wherein the free fatty acid comprises from about 12 to about 25 total carbon atoms.

4. The article of claim 1, wherein the hydrophilic plasticizer is chosen from glycerol, ethylene glycol, propylene glycol, diethylene glycol, dipropylene glycol, sorbitol, erythritol, or mixture thereof.

5. The article of claim 4, wherein the composition further comprises a perfume microcapsule.

6. The article of claim 4, wherein the weight percentage of the free fatty in said composition is determined by the Total Fatty Acid Determination Test method.

7. The article of claim 6, wherein the Iodine Value of the fatty acid is from about 40 to about 140.

8. The article of claim 7, wherein the composition further comprises an alkoxylated nonionic surfactant.

9. The article of claim 7, wherein the composition further comprises an ethoxylated nonionic surfactant.

10. The article of claim 7, wherein the composition comprises a level of C18:3 less than 3% by weight of the total weight of the free fatty acid.

11. The article of claim 7, wherein the fatty moiety of the free fatty acid is not substituted.

12. The article of claim 11, wherein the unsubstituted free fatty acid comprises oleic acid.

13. The article of claim 12, wherein the composition further comprises a solvent wherein the solvent is chosen from propylene glycol, dipropylene glycol, polyethylene glycol, glycerin, or a mixture thereof.

14. The article of claim 13, wherein the composition further comprises a perfume microcapsule.

15. A kit comprising an article of claim 1 and instructions instructing a user to dose the article for the wash cycle of an automatic laundry washing machine.

16. A method of softening fabric comprising the step of dosing the article of claim 1 for the wash cycle of an automatic laundry washing machine.

17. An article comprising: a unitized dose of a fabric care composition; and a water soluble film;

wherein the composition comprises from about 10% to about 99% fatty acid by weight of the composition;

wherein the article comprises less than about 5% by weight of the composition of a guaternary ammonium compound;

wherein the unitized dose comprises a weight from about 1 g to about 60 g;

wherein the water soluble film encases the entire composition; and wherein the article comprises less than 5% by weight of the composition of an anionic surfactant, wherein the article consists essentially of one compartment.

18. An article comprising: a unitized dose of a fabric care composition; and a water soluble film;

wherein the composition comprises from about 10% to about 99% fatty acid by weight of the composition;

wherein the article comprises less than about 5% by weight of the composition of a quaternary ammonium compound;

wherein the unitized dose comprises a weight from about 1 g to about 60 g;

wherein the water soluble film encases the entire composition; and wherein the article comprises less than 5% by weight of the composition of an anionic surfactant, wherein the article comprises at least two compartments.

* * * * *